US008490423B2

(12) United States Patent
Joergensen et al.

(10) Patent No.: US 8,490,423 B2
(45) Date of Patent: Jul. 23, 2013

(54) CONTAINER WITH AIR GUIDE

(75) Inventors: Gert Joergensen, Graasten (DK); Lars Lubker, Haderslev (DK)

(73) Assignee: Maersk Container Industri AS, Tinglev (DK)

( * ) Notice: Subject to any disclaimer, the term of this patent is extended or adjusted under 35 U.S.C. 154(b) by 446 days.

(21) Appl. No.: 12/745,370

(22) PCT Filed: Dec. 2, 2008

(86) PCT No.: PCT/DK2008/000426

§ 371 (c)(1),
(2), (4) Date: Jul. 21, 2010

(87) PCT Pub. No.: WO2009/071083

PCT Pub. Date: Jun. 11, 2009

(65) Prior Publication Data

US 2010/0300133 A1 Dec. 2, 2010

(30) Foreign Application Priority Data

Dec. 4, 2007 (DK) ..... 2007 01730

(51) Int. Cl.
*F25D 23/12* (2006.01)

(52) U.S. Cl.
USPC ..... 62/259.1; 62/407

(58) Field of Classification Search
USPC ..... 62/259.1, 407, 419, 414, 314; 312/116, 312/124; 454/180, 188, 193
See application file for complete search history.

(56) References Cited

U.S. PATENT DOCUMENTS

| | | | | |
|---|---|---|---|---|
| 3,230,733 | A * | 1/1966 | Rutishauser et al. | 62/256 |
| 3,590,594 | A * | 7/1971 | Arend | 62/117 |
| 3,699,870 | A | 10/1972 | Cantagallo et al. | |
| 3,702,544 | A * | 11/1972 | Grinups | 62/414 |
| 3,831,395 | A * | 8/1974 | Levy | 62/263 |
| 3,991,589 | A | 11/1976 | Rath et al. | |
| 4,143,588 | A | 3/1979 | Exler | |

(Continued)

FOREIGN PATENT DOCUMENTS

| | | |
|---|---|---|
| DE | 20 46 926 | 3/1972 |
| DE | 2046926 | 3/1972 |
| GB | 2098362 A | 11/1982 |

OTHER PUBLICATIONS

PCT Search Report for Serial No. PCT/DK2008/000426 dated Jul. 27, 2009.

*Primary Examiner* — Mohammad M Ali
(74) *Attorney, Agent, or Firm* — McCormick, Paulding & Huber LLP

(57) ABSTRACT

In a container 1 with an end wall 5, an air treatment system 6 that is arranged in the end wall 5 and comprises an opening 14 on its bottom side, through which it emits an air flow, a floor 2 provided with channels guiding the air flow in a direction away from the end wall 5, and an air guide 15 forming, in an operation position, together with a part of the end wall 5 and a part of the floor 2 an air channel 16 that guides the air flow between the opening 14 and the channels in the floor, it is endeavoured to prevent the air guide from being damaged by the forks of a fork lift truck. This is achieved in that the container 1 comprises a spring arrangement that counteracts a movement of the air guide 15 in the direction of the end wall 5.

15 Claims, 4 Drawing Sheets

U.S. PATENT DOCUMENTS 4,284,128 A * 8/1981 Nelson ..... 165/48.1
4,338,792 A * 7/1982 Ibrahim ..... 62/256
4,553,403 A 11/1985 Taylor
4,838,757 A * 6/1989 Benesh ..... 415/4.4
4,861,095 A 8/1989 Zajic
5,027,615 A * 7/1991 Wakatsuki et al. ..... 62/419
5,048,306 A * 9/1991 Wakatsuki et al. ..... 62/419
5,187,945 A 2/1993 Dixon
5,609,388 A * 3/1997 Hattass et al. ..... 296/217
6,725,680 B1 * 4/2004 Schenk et al. ..... 62/186
6,758,057 B2 7/2004 Vince, II et al.
7,275,389 B2 * 10/2007 Bae ..... 62/419

* cited by examiner

CONTAINER WITH AIR GUIDE

CROSS REFERENCE TO RELATED APPLICATIONS

This application is entitled to the benefit of and incorporates by reference essential subject matter disclosed in International Patent Application No. PCT/DK2008/000426 filed on Dec. 2, 2008 and Danish Patent Application No. PA 2007 01730 filed Dec. 4, 2007.

FIELD OF THE INVENTION

The present invention relates to containers and, more particularly, to air guides therefor.

BACKGROUND OF THE INVENTION

When transporting sensitive goods, like fruit, vegetables and plants, certain environmental conditions must be observed. Therefore, containers for the transport of such goods are typically provided with air treatment systems, like cooling, heating, dehumidification and/or humidification systems. In standardised containers, which are, for example, used for overseas transports, the system is usually arranged in an end wall, where the treated air is delivered downwards and the return air from the inside of the container is sucked in from above. In order to distribute the treated air optimally in the container, the floor of the container is often provided with channels, for example by inserting so-called T-floors, as known from, for example, the patent U.S. Pat. No. 4,861,095. The channels guide the air supplied from the air treatment system through the floor away from the system. From the channels in the floor, the treated air penetrates into the inner chamber of the container through slots.

It is already known that the distribution of the air and the efficiency of the system can be improved, if a closed channel is arranged at the transition between the air treatment system and the channels of the floor. It is also known to arrange an air guide between the system and the floor in such a manner that, together with the end wall, the floor and the side walls of the container, it forms such a channel. The channel must be accessible for cleaning, and therefore, the air guide is usually mounted to be openable and made of light-weight materials, for example aluminium or glass-fibre reinforced plastic. In order to prevent the air guide from being hit by the forks of a fork-lift truck, when handling the transported goods, it is usually provided with an inward bulge in the direction of the end wall. This increases the horizontal distance of the air guide from the projecting parts of the air treatment system, so that the forks must project further from below the goods to be able to hit the air guide. However, it still happens, and therefore stop chocks or stop brackets are often arranged behind the air guide, so that the air guide can only partly be pushed in the direction of the end wall. To a great extent this prevents the channel from being completely jammed, but it still provides no safe protection against damages to the air guide and the stop chocks or brackets. Such damages deteriorate the air distribution and the efficiency of the system, and under certain circumstances, for example in connection with high outdoor temperatures, this may damage the goods. All in all, such damages incur high costs, on the one side because of the devaluation of the goods and on the other side because of the accrued repair costs. Further, particularly when transporting foodstuff, the proper cleaning of the containers is of great importance. Therefore, it would also be advantageous, if the air guide with its equipment would have the smoothest possible surface without edges and corners, as this would make the cleaning of the container easier.

SUMMARY OF THE INVENTION

The purpose of the invention is to overcome the disadvantages of the known air guides mentioned above. This is achieved in that the container is provided with a spring arrangement that counteracts a movement of the air guide in the direction of the end wall. This causes that both stop chocks and stop brackets can be avoided, as the spring arrangement will automatically reset the air guide to its operation position, when it has been pushed in, so that also the cross-section and the function of the channel are restored. When the stop chocks and stop brackets are left out, the air guide can be pushed onto the end wall without meeting any obstructions, which reduces the risk of damaging the air guide.

In order to prevent the air guide from moving away from the end wall by itself or driven by the spring arrangement, a locking device may be provided that stops the air guide when it reaches its operation position. The blocking device is usually manually detachable to enable the access to the inside of the channel. A further advantage of the blocking device is that the spring arrangement can be made more powerful, which provides a safe resetting of the air guide to its operation position.

Preferably, the spring arrangement is formed by a part of the air guide itself, for example in that the air guide is made of a resilient material. This will on the one side save manufacturing costs and on the other side the cleaning of the spring arrangement will be facilitated. Further, this substantially increases the resistance of the air guide towards the forces acting upon it.

In a preferred embodiment the air guide is made of a resilient material and arranged so that in its operation position it rests on an edge, for example on the air treatment system or the end wall. In this connection, the air guide is fixed on the air treatment system or on the end wall above the edge. This ensures a particularly simple spring arrangement. With appropriate material selection and dimensioning of the air guide and of the distance between the edge and the fixing, the spring arrangement can relatively easily be adapted to the individual requirements. The wording "air treatment system or end wall" used here and in the following also comprises equivalent embodiments. Thus, alternatively, the edge and/or the fixing of the air guide could, for example, be arranged on a carrier that is fixed at the side walls of the container, without deviating from the teaching of the invention.

Preferably, the air guide is arranged to be swivelling, so that it can be flipped away from the end wall. Preferably, in this connection, the axis is arranged to be parallel to the end wall. This ensures the access to the inside of the channel.

Preferably, the air guide is fixed to the air treatment system or the end wall by means of hinges that make it particularly easy to flip the air guide away.

Preferably, a part of the air guide is made as a hinge, which further simplifies the manufacturing of the container. The resulting, smooth transition between the air guide and the hinge will also facilitate the cleaning of the container. Alternatively it is preferred that the air guide and the hinges are joined by welding, which similarly facilitates the manufacturing and the cleaning of the container.

Further, it is preferred to provide the air guide with one single hinge that extends over the whole width of the air guide. If the hinge is made as a part of the air guide or joined to it by welding, this makes it particularly easy to achieve a smooth, resistant and air-tight fixing of the air guide. This saves manufacturing costs, improves the life duration of the air guide, enables a faultless cleaning of the air guide and contributes to increasing the efficiency of the air treatment system.

Preferably, the air guide is made of a thermo-plastic material. This makes the manufacturing cost-effective and the air guide resistant, and it is particularly simple to weld hinges onto the air guide, if these are made of the same basis material.

Preferably, the air guide is made of a fibre-reinforced thermo-plastic material, as this provides a particularly sturdy embodiment of the air guide, which contributes to the increase of the life duration.

It is particularly preferred to manufacture the air guide of fibre-reinforced polypropylene, as this material has particularly good properties with regard to wear resistance, fatigue resistance, elasticity and natural stability. This is particularly advantageous, if the hinges are formed by a part of the air guide or welded onto it, as the good properties of the polypropylene can then also be transferred to hinges.

Preferably, near the floor the air guide is provided with a concavity in the direction of the end wall. Preferably, the concavity extends over the whole width of the air guide, which will then be better protected against the impact of the forks when goods are handled by means of fork lift trucks.

Preferably, the air guide extends up to the side walls of the container and ends tightly against those, so that the channel bordered by the air guide is also bordered by the side walls. This makes the transition of the air flow into the channels of the floor as efficient as possible.

Further, it is preferred that the air treatment system is made as a cooling system. Goods that have to be cooled are typically particularly sensitive to deviations of the environmental conditions, and this is why an efficient distribution of the treated air is particularly essential in a cooling container.

BRIEF DESCRIPTION OF THE DRAWINGS

In the following, the invention will be explained on the basis of the drawings, which show.

DETAILED DESCRIPTION OF THE PREFERRED EMBODIMENTS

Figure 1:
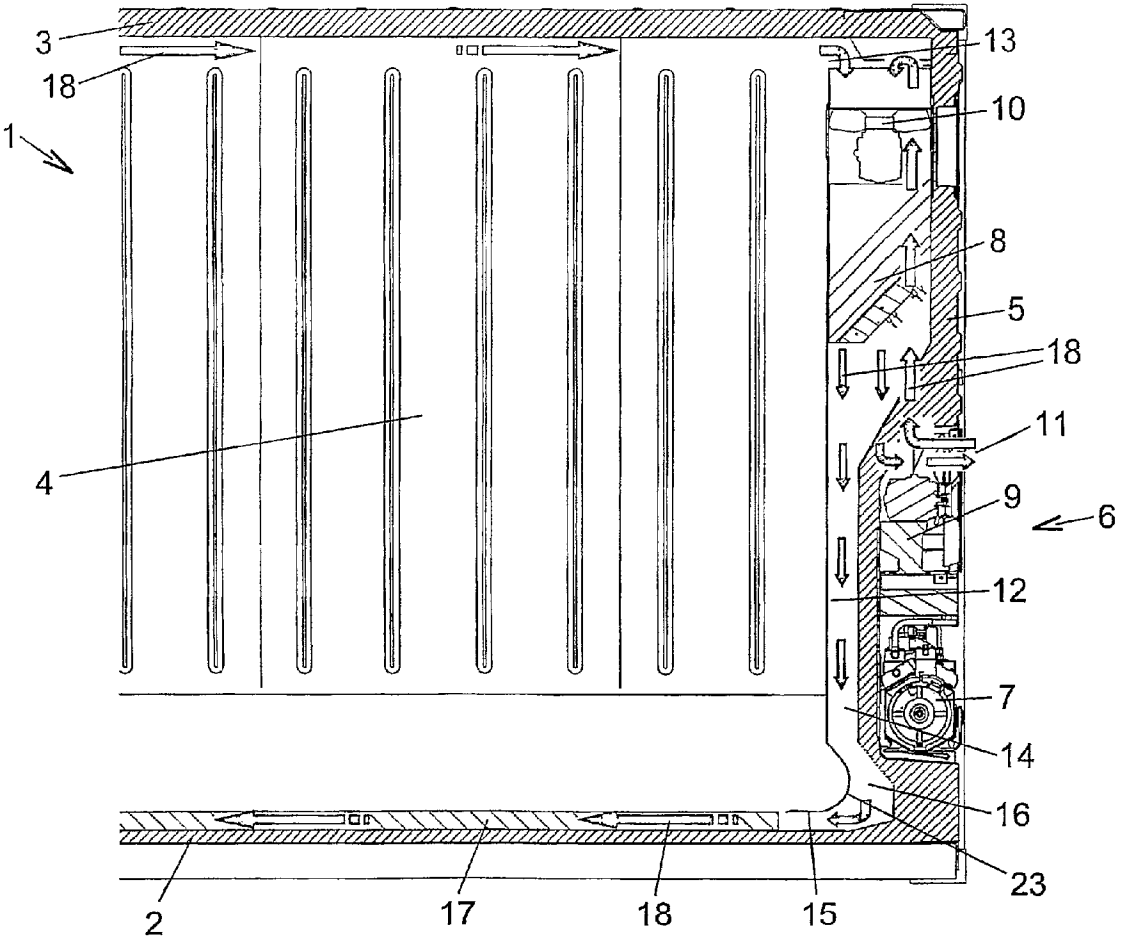
FIG. 1 shows a section through a part of a container according to the invention.

The container in FIG. 1 comprises a floor 2, a roof 3, two side walls 4 and an end wall 5. Further, the container has a second end wall, which is not shown, thus forming a closed inner chamber. In order to achieve a food thermal isolation of the inner chamber of the container 1 in relation to the environment, isolating layers are integrated in the floor 2, the roof 3 and the walls 4, 5. A cooling system 6 known in the art and comprising several components, for example a compressor 7, an evaporator 8, a compressor 9, a fan 10 and a two-way valve 11, is integrated in the end wall 5. Towards the inside of the container 1, the cooling system 6 has a dividing wall 12 that defines an upper opening 13 and a lower opening 14. The upper opening 13 serves the suction of the return air from the container 1, and the lower opening 14 serves the supply of the cooled air into the container 1. Between the lower opening 14 and the floor 2 an air guide 15 is arranged to form an air channel 16 together with a part of the floor 2 and a part of end wall 5, said air guide 15 guiding the cooled air into a number of floor channels formed by T-shaped profile ribs 17 arranged next to one another. In this connection, the profile ribs form a so-called T-floor. In the direction of the end wall 5, the air guide is provided with a concavity 23. The arrows 18 in FIG. 1 show schematically, how the air exchange in the container 1 takes place. The return air is sucked in through the upper opening 13 by the fan 10 and led downwards through the evaporator 8, where it is cooled. The return air is mixed with a small share of outdoor air, which is sucked in through an opening in the two-way valve 11. The overpressure ruling below the evaporator 8 ensures that a corresponding share of the cooled air is emitted to the environment through another opening in the two-way valve 11. The main share of the cooled air is led downwards between the dividing wall 12 and the end wall 5 to the lower opening 14, on through the air channel 16 and into the floor channels between the profile ribs 17. From the floor channels the cooled air ascends through slots (not shown) between the profile ribs 17 into the inner chamber of the container 1. The return air heated by the goods ascends upwards unto the roof 3, where it is again sucked into the cooling system 6 through the upper opening 13.

Figure 2:
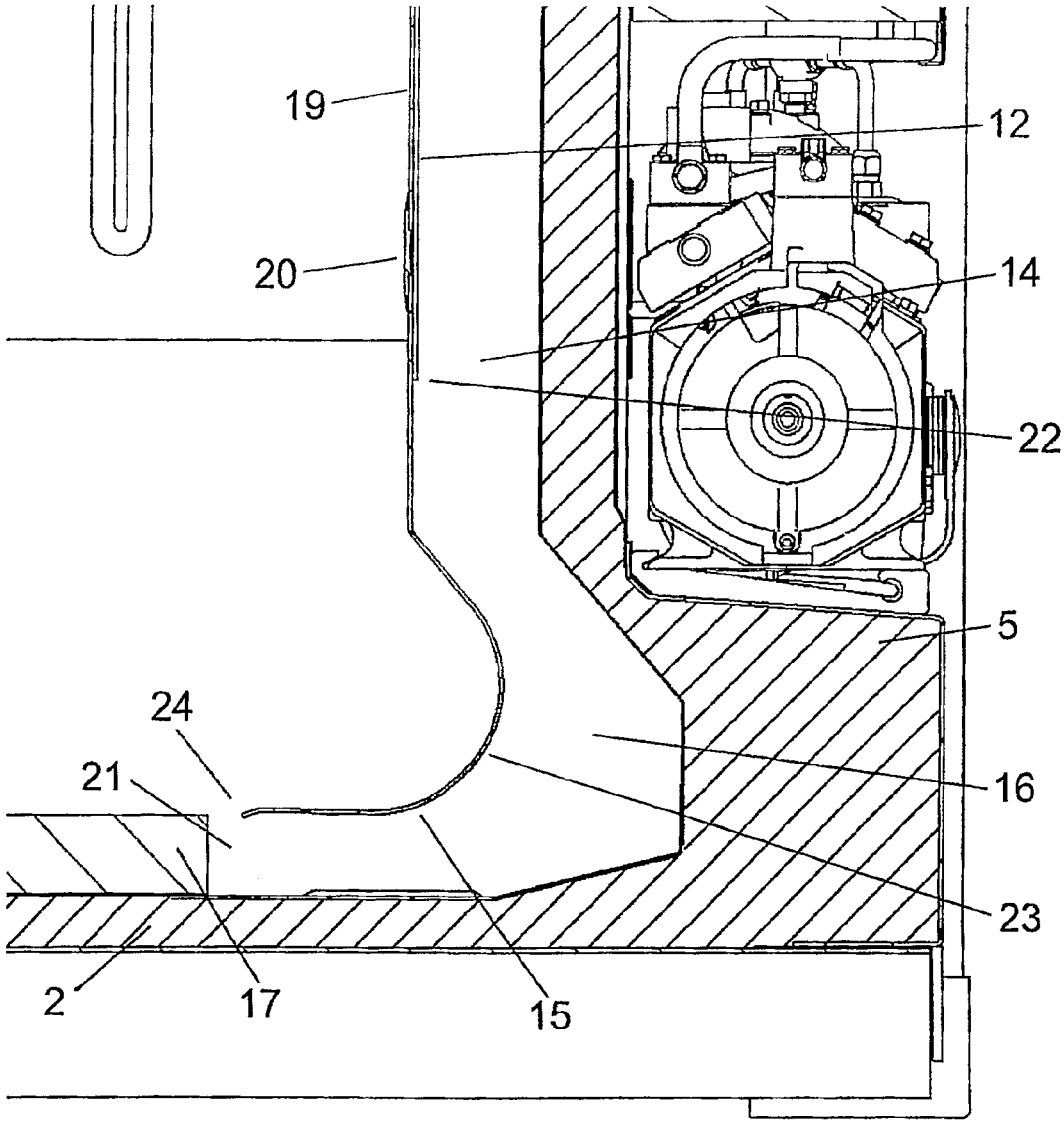
FIG. 2 is a partial section of FIG. 1 with an air guide arranged in the container and assuming its operation position.
Figure 3:
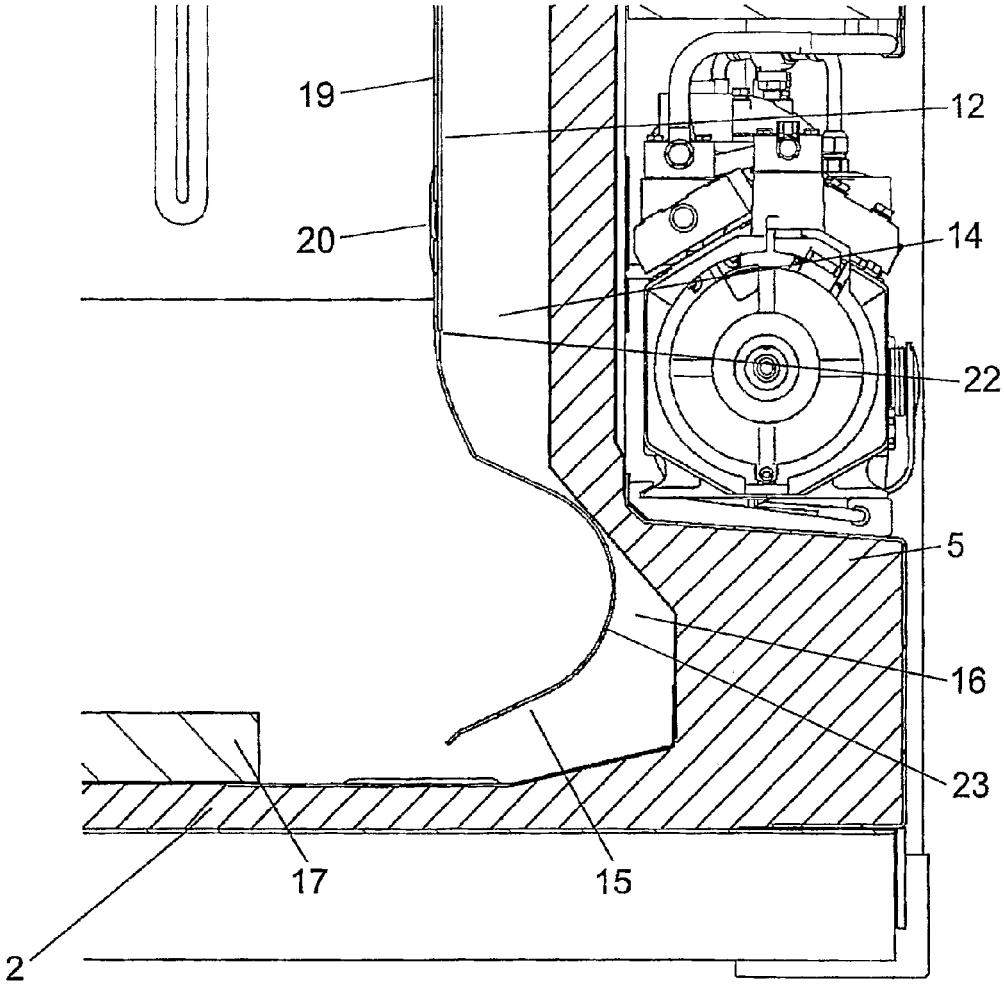
FIG. 3 is a partial section of FIG. 1 with the air guide in a pushed in position.
Figure 4:
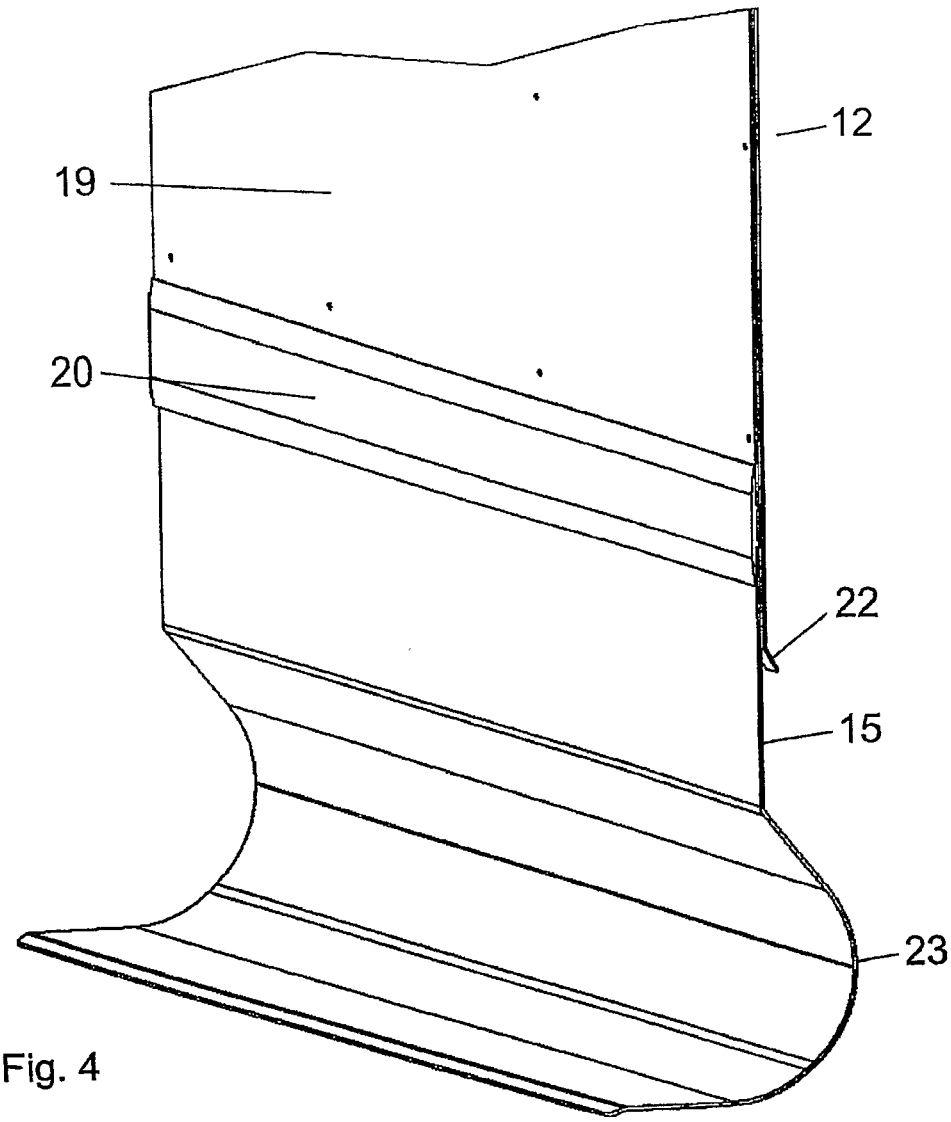
FIG. 4 is a perspective view of the air guide.

Towards the inside of the container 1, the dividing wall 12 is provided with a cover plate 19 (see FIG. 2), which is welded onto the upper connector of a hinge 20, whose lower connector is welded onto the air guide 15. The hinge 20 extends over the whole width of the air guide 15, whose end flushes with the side walls 4. This ensures that the cooled air from the air channel 16 can only escape into the inner chamber of the container 1 in the area of the opening 21 over the floor 2. The dividing wall 12 has a lower edge 22, and the rotation axis of the hinge 20 is arranged somewhat over the edge 22, which thus forms a blocking against pushing the air guide 15 into the air channel 16. The cover plate 19, the air guide 15 and the hinge 20 are made of polypropylene, which enables a smooth weld joining of the parts 19, 20, 15 without problems. Further, the air guide 15 is reinforced with glass fibres to increase the natural stability and the wear resistance. The air guide 15 is made to be elastic, meaning that, as shown in FIG. 3, it can move into the air channel 16, if acted upon by a corresponding force, for example by the forks of a fork lift truck. In this position of the air guide 15, it is acted upon by the edge 22 in the direction away from the end wall 5, whereas the hinge 20 retains it at the dividing wall 12. Thus, the air guide 15 is bent around the edge 22, and its rigidity causes it to attempt to return to its operation position (see FIG. 2). As soon as the fork stops acting upon the air guide 15, the air guide 15 will straighten itself and return to its operation position. The outer edge 24 of the air guide 15 is shaped and arranged so that it cannot right away move past the end of the profile ribs 17, but have to be led across manually. This results in a locking device that prevents the air guide 15 from swivelling beyond its operation position. However, the locking can easily be released, when the air channel 16 must be cleaned, which means that, by means of the hinges 20, the air guide 15 must be lifted up in the direction away from the end wall 5. The lower edge 22 of the dividing wall 12 is rounded (see FIG. 4), so that it has no notch effect on the air guide.

The person skilled in the art can easily make the container 1 with other embodiments without deviating from the basic idea of the invention. Thus, the locking device 24, 17 can be formed by edges at the side walls 4. Further, instead of the air guide 15, other spring devices can be used. For example, the lower part of the dividing wall 12, which also comprises the edge 22, can be made to be resilient. Instead of being fixed to the cooling system 6, the air guide 15 can be fixed to the floor 2, for example by means of hinges 20. This is particularly advantageous, if the flow direction of the air in the air treatment system 6 is reversed. The hinge/hinges 20 can be riveted, screwed or glued to the air guide 15 and/or the fixing surfaces 19, 12, 2. The dividing wall 12 and the cover plate 19 can be made in one piece or joined by welding. The number and the location of the hinges 20 can be varied.

The cover plate, the air guide 15 and the hinge 20 can be made of other suited materials. These are, for example, metals, aluminium, steel, rubber, other thermo-plastics, synthetic resins or plastic materials, as well as combinations thereof. Advantageously, the hinge 20 can be made of thermo-plastic rubber, for example as sold under the commercial name of Santoprene®. In the area of the air guide 15, the side walls 4 of the container 1 can be provided with instances, so that the side walls 4 do only end tightly with the air guide 15, when the air guide 15 is in its operation position.

Further, the invention can be combined with the numerous, already known embodiments of transport containers 1 with air treatment systems 6. In particular, the whole floor 2 and/or the profile ribs 17 can have different embodiments.

What is claimed is:

1. A container with an end wall, an air treatment system arranged at or in the end wall and having on its bottom side an opening, through which it emits or sucks in an air flow, a floor comprising first channels guiding the air flow in a direction away from or towards the end wall, and an air guide forming, in an operation position, together with a part of the end wall and a part of the floor a second channel that guides the air flow between the opening and the first channels, wherein the container comprises a spring arrangement that counteracts a movement of the air guide in the direction of the end wall.

2. The container according to claim 1, wherein it comprises a detachable locking device that prevents the air guide from being moved away from the end wall beyond the operation position.

3. The container according to claim 1, wherein the spring arrangement is formed by a part of the air guide.

4. The container according to claim 3, wherein the air treatment system or the end wall comprises a horizontal edge, on which the air guide rests in the operation position, and that the air guide is fixed to the air treatment system or the end wall above the edge.

5. The container according to claim 1, wherein from the operation position the air guide can be swivelled away from the end wall around a horizontal axis that is parallel to the end wall.

6. The container according to claim 1, wherein the air guide is fixed to the air treatment system or the end wall by means of at least one hinge.

7. The container according to claim 6, wherein at least one hinge is formed by a part of the air guide.

8. The container according to claim 6, wherein at least one hinge is connected to the air guide by means of welding.

9. The container according to claim 7, wherein the air guide is fixed over its whole width by means of one single hinge.

10. The container according to claim 1, wherein the air guide is made of a thermo-plastic material.

11. The container according to claim 1, wherein the air guide is made of a fibre-reinforced thermo-plastic material.

12. The container according to claim 1, wherein the air guide is made of glass fibre-reinforced polypropylene.

13. The container according to claim 1, wherein near the floor the air guide comprises a horizontal concavity in the direction of the end wall.

14. The container according to claim 1, wherein further it comprises two side walls connected to the end wall, and that the air guide ends tightly against the side walls.

15. The container according to claim 1, wherein the air treatment system is a cooling system.

* * * * *